US008087987B2

(12) United States Patent
Mruk

(10) Patent No.: US 8,087,987 B2
(45) Date of Patent: Jan. 3, 2012

(54) METHOD AND SYSTEM FOR PLAYING A BOWLING GAME IN COMBINATION WITH A SECONDARY CARD GAME

(75) Inventor: James C Mruk, Henderson, NV (US)

(73) Assignee: Jam-N Enterprises, Inc., Henderson, NV (US)

( * ) Notice: Subject to any disclaimer, the term of this patent is extended or adjusted under 35 U.S.C. 154(b) by 0 days.

(21) Appl. No.: 12/931,179

(22) Filed: Jan. 25, 2011

(65) Prior Publication Data

US 2011/0124424 A1 May 26, 2011

Related U.S. Application Data

(63) Continuation-in-part of application No. 11/866,409, filed on Oct. 2, 2007.

(51) Int. Cl.
*A63F 1/00* (2006.01)
*A63D 3/00* (2006.01)

(52) U.S. Cl. ..... 463/13; 473/54; 434/249

(58) Field of Classification Search ..... 463/13; 473/54; 434/249
See application file for complete search history.

(56) References Cited

U.S. PATENT DOCUMENTS 4,597,575 A 7/1986 Kosof
4,787,633 A 11/1988 Fritzemeier
4,817,947 A 4/1989 Gautraud
5,899,815 A 5/1999 Helou et al.
6,270,411 B1 8/2001 Gura et al.
6,464,595 B2 * 10/2002 Tsujita ..... 473/70
2003/0087707 A1 * 5/2003 Lavoie et al. ..... 473/54
2008/0171607 A1 7/2008 Minard et al.
2010/0134687 A1 * 6/2010 Vaioli ..... 348/578
2010/0227658 A1 9/2010 Crowder et al.

* cited by examiner

*Primary Examiner* — Dmitry Suhol
*Assistant Examiner* — Malina K Rustemeyer
(74) *Attorney, Agent, or Firm* — Michael Artemis

(57) ABSTRACT

A method and system for playing a bowling game in combination with a poker-type card game is disclosed. The method and system comprising the steps of initiating a conventional bowling game, filling at least one bowling frame, dealing one or more hole cards to a player, continuing the bowling game for one or more additional frames, dealing one or more community cards, continuing the bowling game for one or more additional frames, dealing another set of one or more community cards, continuing the bowling game for one or more additional frames, dealing a final set of community cards, completing the bowling game by filling a final bowling frame, determining a final bowling score, determining if a poker hand formed from a combination of hole cards and community cards is a winning hand, providing a poker award if the poker hand is a winning hand, and combining the poker award with the final bowling score to create an enhanced bowling score.

24 Claims, 7 Drawing Sheets

300

301

204

| | Frame 1 | Frame 2 | Frame 3 | Frame 4 | Frame 5 | Frame 6 | Frame 7 | Frame 8 | Frame 9 | Frame 10 |
|---|---|---|---|---|---|---|---|---|---|---|
| Bowler 1A | X | X | X | X | X | | | | | |
| Jim | 30 | 60 | 90 | | | | | | | |
| Bowler 1B | 9 0 | X | 8 / | X | 7 / | | | | | |
| Ashley | 9 | 29 | 49 | 69 | | | | | | |
| Bowler 1C | X | 8 / | X | 9 / | 8 / | | | | | |
| Mary | 20 | 40 | 60 | 78 | | | | | | |
| Bowler 2A | 7 2 | X | 7 / | 9 0 | 6 3 | | | | | |
| Nicole | 9 | 29 | 48 | 57 | 66 | | | | | |
| Bowler 2B | 6 / | X | 8 0 | X | X | | | | | |
| Mike | 20 | 38 | 46 | | | | | | | |

206 208 210 212 214

400

401

204

| | Frame 1 | Frame 2 | Frame 3 | Frame 4 | Frame 5 | Frame 6 | Frame 7 | Frame 8 | Frame 9 | Frame 10 |
|---|---|---|---|---|---|---|---|---|---|---|
| Bowler 1A | X | X | X | X | X | X | X | | | |
| Jim (206) | 30 | 60 | 90 | 120 | 150 | | | | | |
| Bowler 1B | 9 0 | X | 8 / | X | 7 / | X | X | | | |
| Ashley (208) | 9 | 29 | 49 | 69 | 89 | | | | | |
| Bowler 1C | X | 8 / | X | 9 / | 8 / | 9 / | X | | | |
| Mary (210) | 20 | 40 | 60 | 78 | 98 | 118 | | | | |
| Bowler 2A | 7 2 | X | 7 / | 9 0 | 6 3 | X | 8 / | | | |
| Nicole (212) | 9 | 29 | 48 | 57 | 66 | 86 | | | | |
| Bowler 2C | 6 / | X | 8 0 | X | X | 5 4 | X | | | |
| Mike (214) | 20 | 38 | 46 | 71 | 90 | 99 | | | | |

| | Frame 1 | Frame 2 | Frame 3 | Frame 4 | Frame 5 | Frame 6 | Frame 7 | Frame 8 | Frame 9 | Frame 10 |
|---|---|---|---|---|---|---|---|---|---|---|
| Bowler 1A | X | X | X | X | X | X | X | X | X | |
| Jim | 30 | 60 | 90 | 120 | 150 | 180 | 210 | | | |
| Bowler 1B | 9 0 | X | 8 / | X | 7 / | X | X | 9 / | X | |
| Ashley | 9 | 29 | 49 | 69 | 89 | 118 | 138 | 158 | | |
| Bowler 1C | X | 8 / | X | 9 / | 8 / | 9 / | X | 7 / | 9 0 | |
| Mary | 20 | 40 | 60 | 78 | 97 | 117 | 137 | 156 | 165 | |
| Bowler 2A | 7 2 | X | 7 / | 9 0 | 6 3 | X | 8 / | X | X | |
| Nicole | 9 | 29 | 48 | 57 | 66 | 86 | 106 | | | |
| Bowler 2B | 6 / | X | 8 0 | X | X | 5 4 | X | X | 9 / | |
| Mike | 20 | 38 | 46 | 71 | 90 | 128 | 148 | 158 | | |

METHOD AND SYSTEM FOR PLAYING A BOWLING GAME IN COMBINATION WITH A SECONDARY CARD GAME

RELATED APPLICATIONS

This application claims priority to and is a continuation-in-part of U.S. patent application Ser. No. 11/866,409 entitled Bowl N Hold-em filed on Oct. 2, 2007 which is currently pending.

BACKGROUND OF THE INVENTION

1. Field of the Invention

The present invention relates to the sport of bowling and in particular to a method and system for playing a bowling game.

2. Related Art

Bowling is a popular sport that has been around for centuries. It is one of the oldest most widely played games in the world. The sport of bowling is played recreationally, in organized leagues and in various competitions by millions of people, of every age, any gender. Since the inception of bowling, which can be traced back to the Stone Age, the game has evolved from a very basic/rudimentary form of the sport, to the high-tech game of bowling that is known and played today. Over the years, there have been many variations and improvements to the game to continually challenge a player, maintain player interest and increase public interest regarding the sport.

In one known variation, a player participating in a bowling game is presented with an alternate game play method which modifies the traditional number of balls that may be delivered in a particular frame. This known variation, while somewhat useful, has drawbacks. In both the conventional and this variation of bowling, the determination of the winning score is cumbersome and difficult for many players to understand and perform. Another drawback is that merely altering the number of balls that may be delivered during a particular frame reduces the excitement and challenge of having to perform well during that frame.

Another known variation of bowling, attempts to provide a bowling game that is more exciting and easier to understand. In this variation, the traditional game of bowling is combined with the player betting with an allotted number of betting points during each frame. This known variation, while somewhat useful, has substantial drawbacks. One drawback pertains to the added layer of complexity in determining and tracking multiple payer bets for each frame. Another drawback with this variation is that a player may engage in a betting strategy that produces less than desired results, thereby decreasing the excitement and desire of the player to continue playing.

In other known variations of bowling, various attempts have been made to alter or handicap the score of a new or challenged player. These known variations, while somewhat useful, have significant drawbacks. Firstly, as stated above, the determination of a winning score in a traditional game of bowling is rather difficult and time consuming to perform. Secondly, the determination of the score is highly dependent upon the specific sequence in which the players obtain strikes and spares and the application of various handicapping methods may provide inconsistencies in scoring. Finally, the adaptation of one or more of these various handicapping methods may greatly increase the complexity of the game and further limit the understanding for a new player.

In one known improvement, a significant technological advancement in the ease of scoring a game of bowling was provided. This improvement generally comprised the introduction of the automatic pinspotter and computerized scoring system. This known improvement, while somewhat useful, has substantial drawbacks. One primary drawback is the increased expense in installing and maintaining this equipment. For large commercial bowling centers, the cost associated with providing these advanced systems may be deferred across many bowling lanes, however, for smaller bowling centers these costs usually take a very long time to defer. So much so, that some smaller bowling centers may chose to forgo the installation of such systems. Another drawback is the ease of use for the player. Some systems are complex and require some form of user training which takes time away from the bowling activity.

Efforts to provide a method and system for playing a bowling game that overcomes the drawbacks in the prior art have not met with significant success to date. As a result, there is a need in the art for a method and system for playing a bowling game capable of increasing player excitement and facilitating the scoring process. The method and system described herein overcomes these drawbacks and provides additional new and useful benefits.

SUMMARY OF THE INVENTION

To overcome the drawbacks of the existing systems and provide additional benefits, a method and system is disclosed which increases player excitement and facilitates the scoring process.

From the broadest method aspect, the invention comprises a method of playing a bowling game in which players are permitted to participate in a secondary poker-type card game by election. The method includes the steps of: (a) initiating a bowling game, wherein at least one player participates in a poker-type card game in combination with the bowling game; (b) dealing at least one card to the at least one player during the bowling game, wherein the at least one card is from a randomized collection of cards; (c) dealing a plurality of community cards during the bowling game, wherein the plurality of community cards are useable by the at least one player to assemble a poker hand; (d) completing the bowling game by filling a final bowling frame; (e) determining a final bowling score for each player; (f) determining if the poker hand of the at least one player is a winning hand, wherein the poker hand is formed by combining the at least one card dealt to the at least one player, and the plurality of community cards to form a best multi-card poker hand; and (g) providing a poker award if the poker hand is a winning hand.

In another exemplary embodiment, the invention provides a method of playing a bowling game in which players are permitted to participate in a secondary poker-type card game by election. The method comprises the steps of: (a) initiating a bowling game, where one or more players participates in a poker-type card game in combination with a conventional bowling game; (b) filling one or more bowling frames, preferably three frames; (c) dealing one or more one cards, preferably two cards, to one or more players from a randomized collection of cards; (d) continuing the bowling game and filling one or more, preferably two, additional bowling frames; (e) dealing one or more first community cards, preferably three cards, where the first community cards are useable by the players to assemble a poker hand; (f) continuing the bowling game and filling one or more, preferably two, additional bowling frames; (g) dealing one or more, preferably one card, as a second community card, where the second community card is useable by the players to assemble the poker hand; (h) continuing the bowling game and filling one or more, preferably two, additional bowling frames; (i) dealing one or more, preferably one, final community card, where the final community card is useable by the players to assemble the poker hand; (k) completing the bowling game by filling a final bowling frame; (l) determining a final bowling score for each player; (m) determining if the poker hand of the player is a winning hand, where the poker hand is formed by combining the one or more cards dealt to the player, the one or more first community card, the one or more second community card and the one or more third community card to form a best multi-card poker hand; and (n) providing a poker award if the poker hand is a winning hand.

In an alternate embodiment the modified method further includes the steps of: combining the poker award for each player with the final bowling score for each player to create an enhanced bowling score for each player; determining if the one or more players obtained three consecutive strikes in the final bowling frame; and awarding a poker bonus if the player/s obtained three consecutive strikes in the final bowling frame. The modified method may further include the step of replacing the one or more cards previously dealt to the player/s with a highest ranking card from the randomized collection of cards.

In another exemplary embodiment, the invention provides a scoring system for a bowling game. The scoring system includes one or more display devices, at least one scoring computer operatively coupled to the one or more display devices. The scoring computer includes a memory and a processor operatively coupled to the one or more display devices and the memory. The memory has a machine readable code stored therein, the machine readable code is configured to enable the processor to perform the following steps: (a) initiate a bowling game, where at least one player participates in a poker-type card game in combination with the bowling game; (b) score at least one bowling frame; (c) display on the one or more display devices at least one card virtually dealt to the at least one player from a randomized collection of cards; (d) continue the bowling game and score at least one first additional bowling frame; (e) display on the one or more display devices at least one first community card; (f) continue the bowling game and score at least one second additional bowling frame; (g) display on the one or more display devices at least one second community card; (h) continue the bowling game and score at least one third additional bowling frame; (i) display on the at least one display device at least one third community card; (k) complete the bowling game by scoring a final bowling frame; (l) determine a final bowling score for each player; (m) determine if the poker hand of the player/s is a winning hand, where the poker hand is formed by combining the at least one card dealt to the at least one player, the at least one first community card, the at least one second community card and the at least one third community card to form a best multi-card poker hand; and (n) provide a poker award if the poker hand is a winning hand.

In an alternate embodiment the scoring system further includes machine executable code that is configured to: combine the poker award for each player with the bowling score for each player to generate and display on the one or more display devices an enhanced bowling score for each player determine if the one or more players obtained three consecutive strikes in the final bowling frame; and award a poker bonus if the player/s obtained three consecutive strikes in the final bowling frame. The scoring system machine executable code may further include replacing the one or more cards previously dealt to the player/s with a highest ranking card from the randomized collection of cards. Another embodiment provides an award for the enhanced bowling score.

Other systems, methods, features, step combinations and advantages of the invention will be or will become apparent to one having ordinary skill in the art upon examination of the following figures and detailed description. It is intended that all such additional systems, methods, features, step combinations and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts/elements/steps throughout the different views.

DETAILED DESCRIPTION OF THE PREFERRED EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In the following description, numerous specific details are set forth in order to provide a more thorough description of the present invention. It will be apparent, however, to one of ordinary skill in the art, that the present invention may be practiced without these specific details. In other implementations, well-known features and methods have not been described in detail so as not to obscure the invention. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
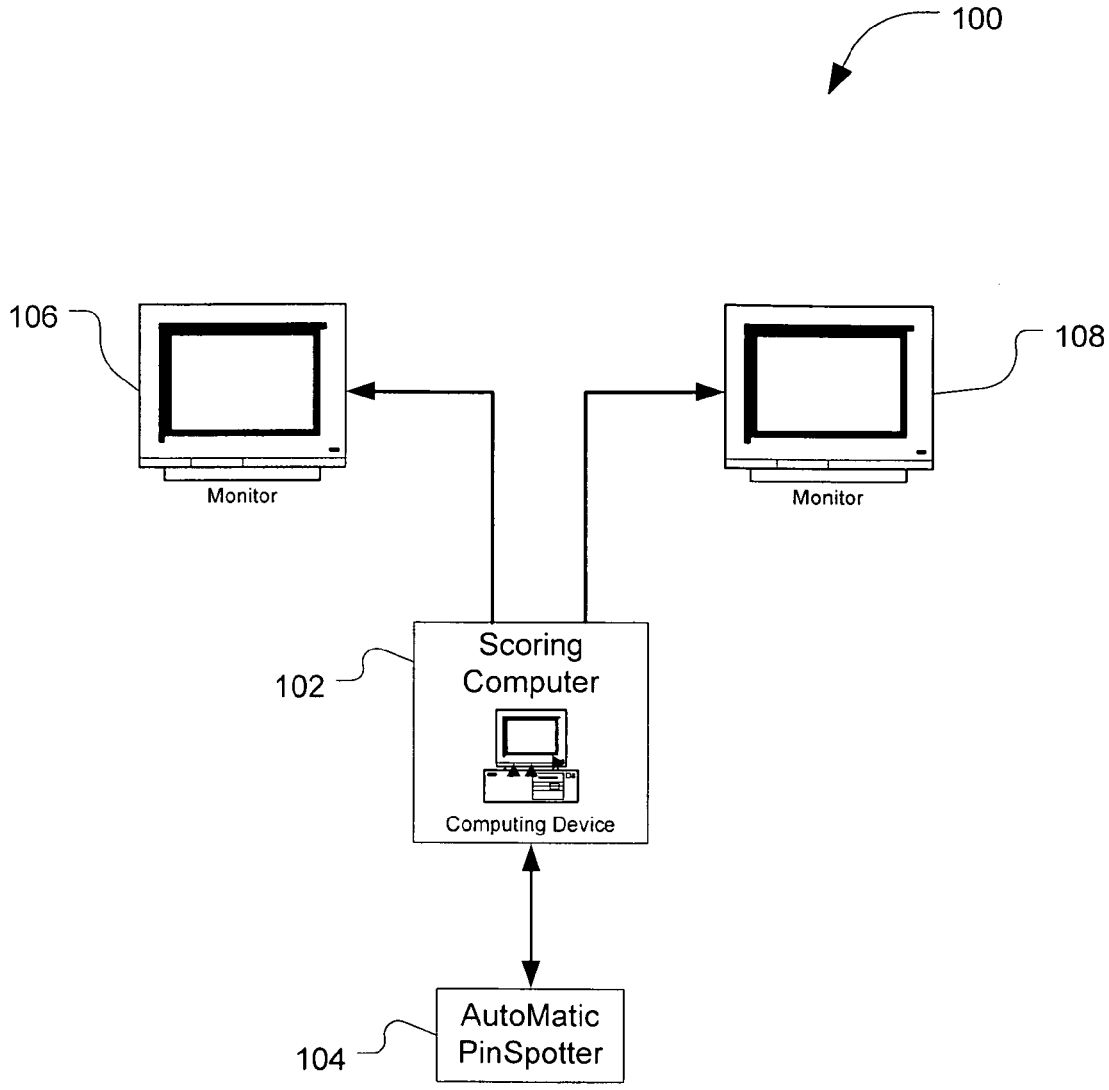
FIG. 1 is a schematic illustrating elements of a bowling scoring system utilized in an exemplary embodiment in accordance with the present invention.

A bowling scoring system 100 is shown in FIG. 1. The scoring system 100 generally comprises at least one scoring computer 102. The scoring computer 102 commonly has at least one input device such as a keyboard, touchpad or other means for a player to input data into the computer 102. Further, computer 102, may include, one or more processors, a display device, data storage devices, memory and other associated hardware that are operatively coupled together and provide computing functionality. The computer 102 also includes one or more algorithms or machine readable code that facilitates the storage, processing, and display of information in accordance with the present invention. The computer 102 has memory configured with machine readable code stored thereon, wherein the processor is configured to read and execute the machine readable code. Computer 102 is operatively coupled to at least one automatic pinspotter 104, a primary display 106 and at least one secondary display 108. The automatic pinspotter 104 provides scoring computer 102 with real-time data regarding the status of the bowling pins during a frame of bowling. The functionality of the pinspotter 104 is well-known and will not be described in detail so as not to obscure the invention. Primary display 106 is utilized to display player scoring sheets/cards for each bowling frame and each game. Primary display 106 may be a CRT monitor, an LCD screen, a plasma screen or other type of image displaying device. Additionally, primary display 106 may be partitioned into a plurality of smaller display areas such that multiple types of player data or information may be displayed on that single display. Secondary display 108 is utilized to display information to players during each bowling frame and each game. Secondary display 108 may be a CRT monitor, an LCD screen, a plasma screen or other type of image displaying device. Additionally, secondary display 108 may be partitioned into a plurality of smaller display areas. These partitioned display areas of the secondary display 108 may be configured to display other information, sporting events such as football, baseball, soccer, boxing, racing or combinations thereof. Both primary and secondary displays 106, 108 are typically assigned to a pair of bowling lanes and mounted in a location such that each player can readily view each display.

In accordance with the invention, a conventional game of bowling is played and combined with a poker-type card game such as Texas Hold-em™. It is contemplated that from one to ten or more players may participate per pair of bowling lanes. The conventional game of bowling consists of 10 frames of play and will not be described in detail so as not to obscure the invention. In one exemplary embodiment, each player will be presented the opportunity, when initializing a game of bowling, to select/decide whether or not they would like to participate in the secondary poker-type card game aspect of the bowling match. It is further contemplated, that each player participating in the secondary poker-type card game may be required to pay an additional fee to the bowling center for the opportunity to enjoy this aspect of the bowling match. Correspondingly, only players that have selected/decided to participate in the poker-type card game aspect of the bowling match will receive cards that are drawn at random from a single collection of cards.

Figure 2A:
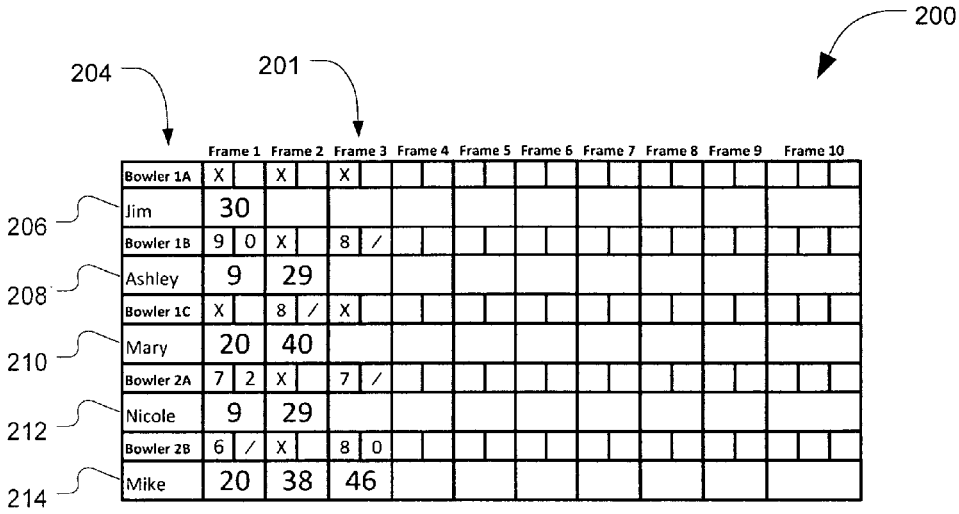
FIG. 2A illustrates a standard scoring sheet after a $3^{rd}$ frame of bowling as used in an exemplary embodiment in accordance with the present invention.
Figure 2B:
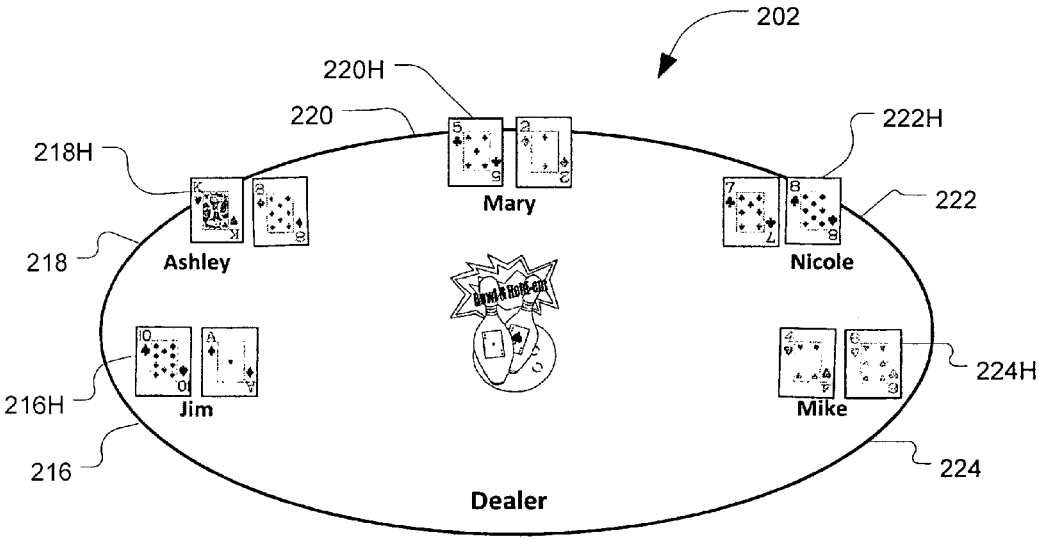
FIG. 2B is a top view of an exemplary poker-type card game table layout illustrating two player hole cards in accordance with an exemplary embodiment of the present invention.

Attention is drawn to FIGS. 2A and 2B in which, FIG. 2A illustrates a standard scoring sheet 200 after a $3^{rd}$ frame of bowling 201 has been completed and FIG. 2B illustrates a top view of an exemplary poker-type card game table layout 202 illustrating two player hole cards having been dealt to each player position. In an exemplary embodiment, the scoring sheet 200 has a plurality of bowlers listed in column 204. Since the bowling scoring system 100 is configured to handle two bowling lanes, typically a Lane 1 and Lane 2 respectively, it is contemplated that the active bowlers will be assigned to a particular starting lane. Typically in a conventional game of bowling, the active bowlers will commence bowling from their assigned starting lane then alternate between Lane 1 and Lane 2 during the remainder of the bowling game.

In the event more than one bowler is assigned to a lane, each bowler will be assigned a sequential letter for further identification. For example, and referring to column 204 of FIG. 2A, there may be three bowlers assigned to Lane 1 and two bowlers assigned to Lane 2. For Lane 1, the first bowler is bowler 1A-"Jim" 206, the second bowler is bowler 1B-"Ashley" 208, and the third bowler is bowler 1C-"Mary" 210. For Lane 2, the first bowler is bowler 2A-"Nicole" 212 and the second bowler is bowler 2B-"Mike" 214.

Once assigned to a lane, each bowler that is participating in the poker aspect of the bowling game is further assigned a player position on the game table layout 202 of FIG. 2B. Each position 216, 218, 220, 222 and 224 has a dedicated area for displaying two pocket or "hole" cards that are dealt face up to each player upon the completion of the third frame of bowling. For example: bowler 1A-"Jim" 206 is assigned to position 216 and dealt two hole cards 216H, bowler 1B-"Ashley" 208 is assigned to position 218 and dealt two hole cards 218H, bowler 1C-"Mary" 210 is assigned to position 220 and dealt two hole cards 220H, bowler 2A-"Nicole" 212 is assigned to position 222 and dealt two hole cards 222H, and bowler 2B-"Mike" 214 is assigned to position 224 and dealt two hole cards 224H. "Hole" cards are for each player to use in building an individual poker hand, the final poker hand will be determined with the use of a plurality of community cards dealt later in the game. Cards dealt during game play may either be actual physical cards from a single randomized collection of cards; alternatively, cards dealt may be electronic representations, associations, renderings or other randomly computer-generated cards. For example, the cards may be dealt electronically by way of a computer generated collection of cards or representations thereof. It should be noted that all the bowlers complete or fill the first, and second frames of bowling in the conventional well-known manner. Each bowling frame is considered "filled" when a bowler makes a strike, or attempts a second shot to pick up a spare. It is only after the completion of the third frame that each player is dealt their respective two pocket/hole cards.

In one exemplary embodiment, scoring sheet 200 may be an electronic form displayed on the primary display 106 of FIG. 1. In an alternate embodiment, scoring sheet 200 may be a traditional paper-type scoring sheet. Additionally, the poker-type card game table layout 202 may be an electronic or digital image displayed on the secondary display 108 of FIG. 1. In an alternative embodiment, layout 202 may be displayed in a partitioned area of the primary display 106, where this partitioned area is separate from display of scoring sheet 200.

Figures 3A, 3B:
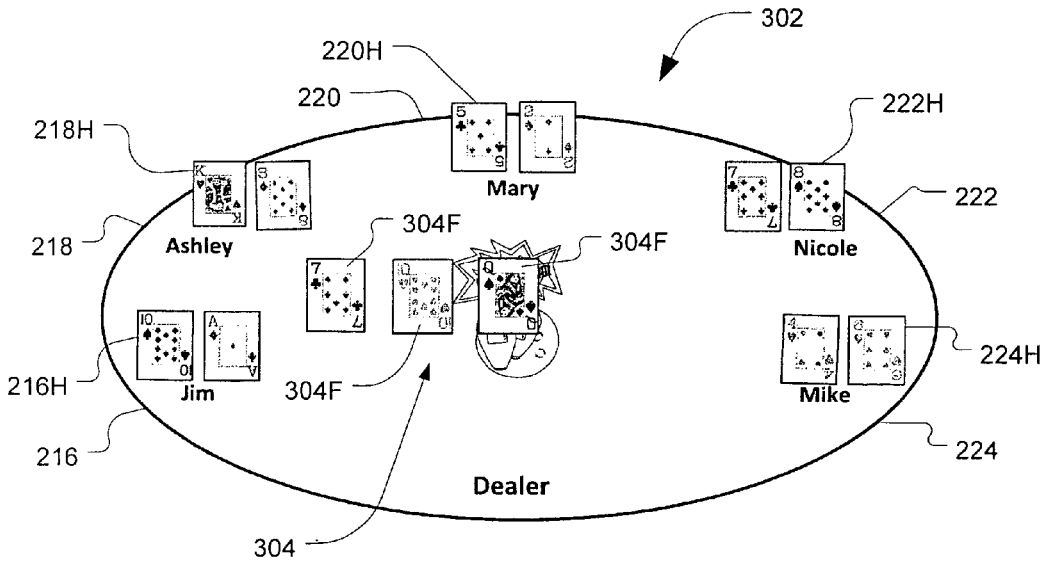
FIG. 3A illustrates a standard scoring sheet after a $5^{th}$ frame of bowling as used in an exemplary embodiment in accordance with the present invention.
FIG. 3B is a top view of an exemplary poker-type card game table layout illustrating the first three community cards in accordance with an exemplary embodiment of the present invention.

The conventional game of bowling now continues through frames four and five. Upon filling frames four and five, the next set of cards is randomly dealt from the single collection or deck of playing cards. Attention is drawn to FIGS. 3A and 3B in which, FIG. 3A illustrates a standard scoring sheet 300 after a 5th frame of bowling 301 has been completed/filled and FIG. 3B illustrates a top view of an exemplary poker-type card game table layout 302 illustrating three community "Flop" cards 304F having been dealt to a community card area 304 located substantially central to the layout 302. The "flop" cards 304F, are community cards that will be used by all active players, in combination with their two hole cards, to complete their individual poker hand in which the best five cards out of seven are played at the end of the bowling game. The bowling game now precedes to frames six and seven.

Figures 4A, 4B:
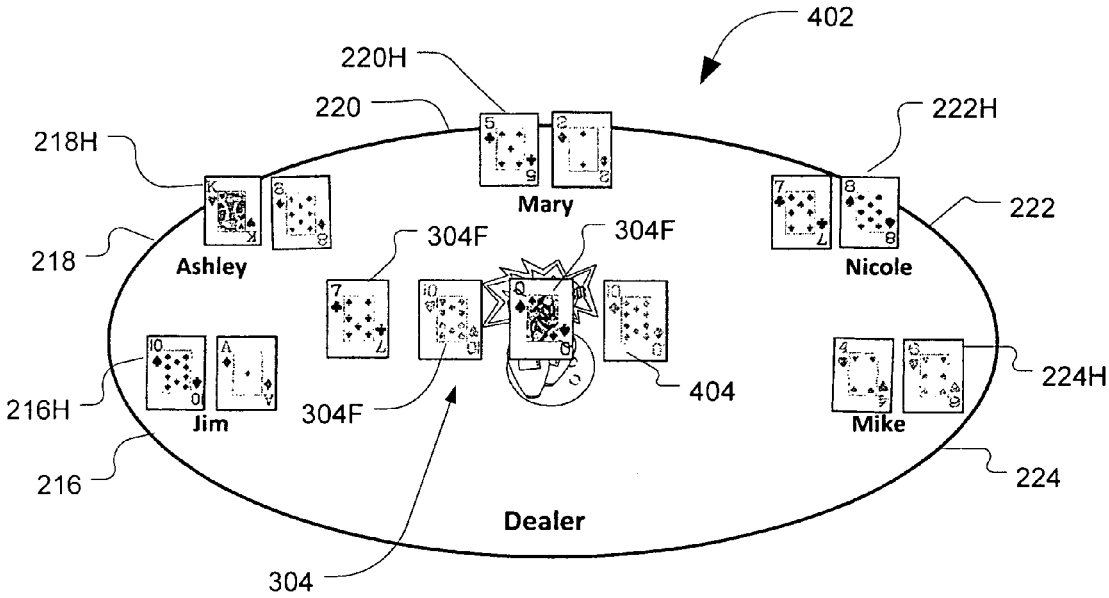
FIG. 4A illustrates a standard scoring sheet after a $7^{th}$ frame of bowling as used in an exemplary embodiment in accordance with the present invention.
FIG. 4B is a top view of an exemplary poker-type card game table layout illustrating a fourth community card in accordance with an exemplary embodiment of the present invention.

Upon filling frames six and seven in the conventional manner, attention is drawn to FIGS. 4A and 4B in which, FIG. 4A illustrates a standard scoring sheet 400 after a $7^{th}$ frame of bowling 401 has been completed/filled and FIG. 4B illustrates a top view of an exemplary poker-type card game table layout 402 illustrating the next community card "Turn" card 404 having been dealt to the community card area 304 located substantially central to the layout 402. The "turn" card 404, is another community card that will be used by all active players, in combination with their two hole cards, to complete their individual poker hand in which the best five cards out of seven are played at the end of the bowling game. The bowling game now precedes to frames eight and nine.

Figure 5A:
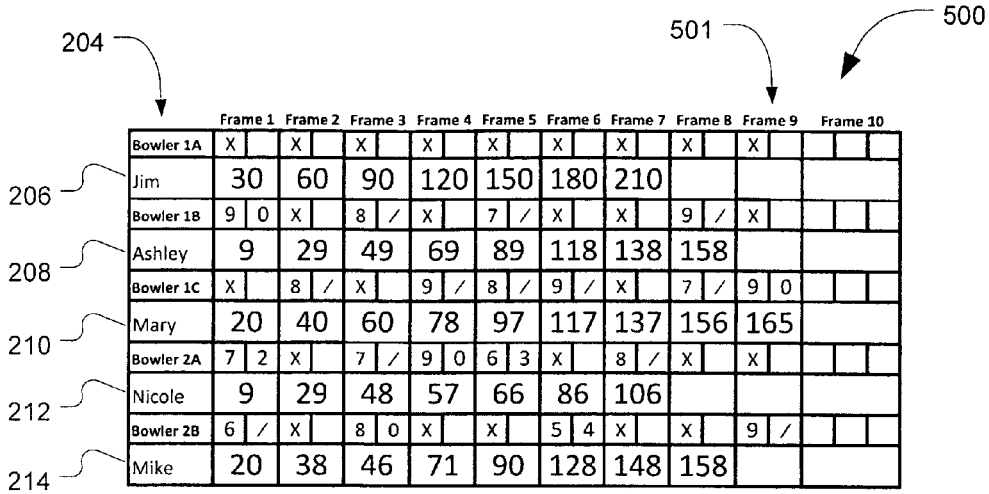
FIG. 5A illustrates a standard scoring sheet after a $9^{th}$ frame of bowling as used in an exemplary embodiment in accordance with the present invention.
Figure 5B:
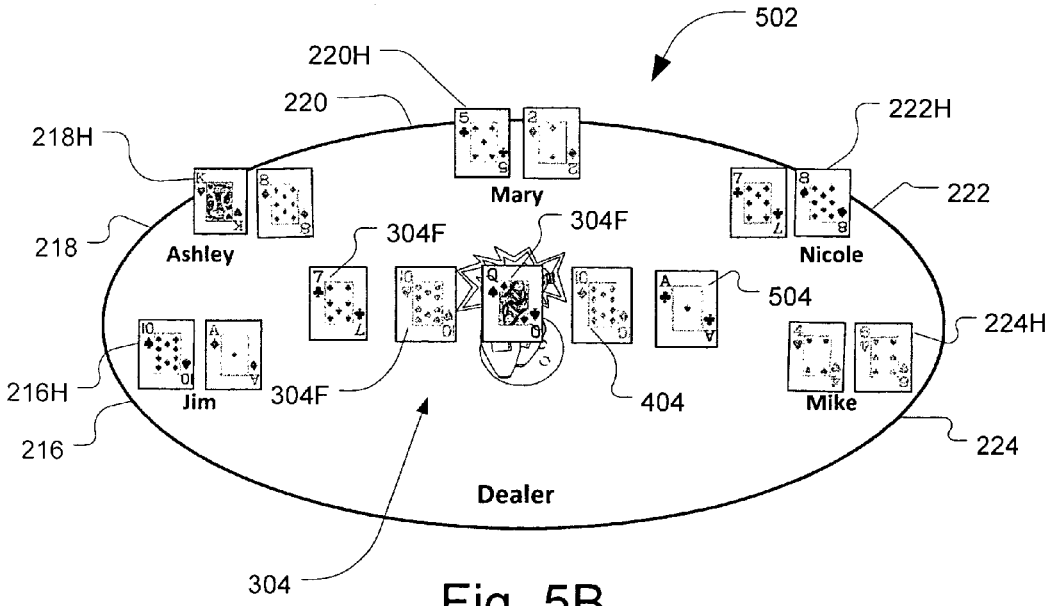
FIG. 5B is a top view of an exemplary poker-type card game table layout illustrating a fifth community card in accordance with an exemplary embodiment of the present invention.

Upon filling frames eight and nine in the conventional manner, attention is drawn to FIGS. 5A and 5B in which, FIG. 5A illustrates a standard scoring sheet 500 after a $9^{th}$ frame of bowling 501 has been completed/filled and FIG. 5B illustrates a top view of an exemplary poker-type card game table layout 502 illustrating the next community card "River" card 504 having been dealt to the community card area 304 located substantially central to the layout 502. The "river" card 504, is the final community card drawn and is another community card that will be used by all active players, in combination with their two hole cards, to complete their individual poker hand in which the best five cards out of seven are played. The bowling game now precedes to frames ten and eleven.

Figure 6:
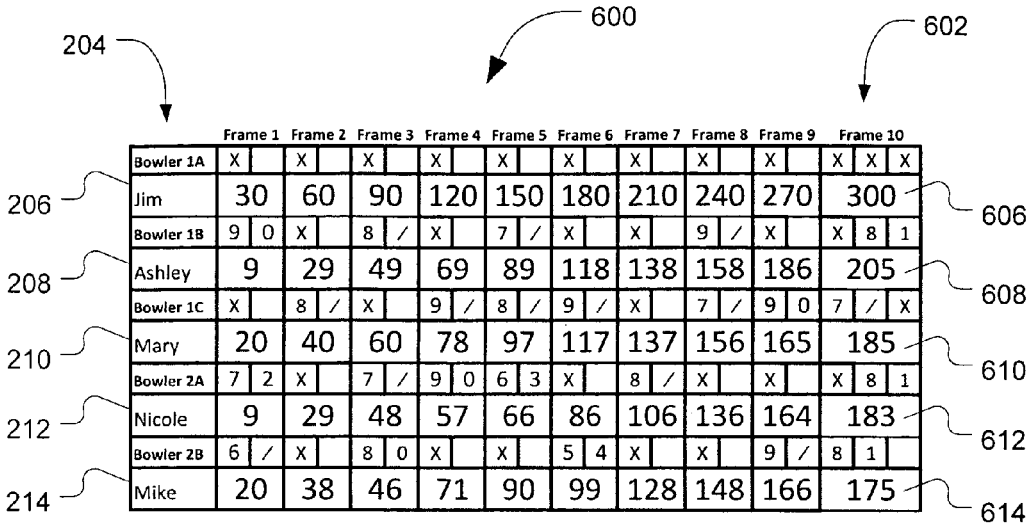
FIG. 6 illustrates a standard scoring sheet after a $10^{th}$ frame of bowling as used in an exemplary embodiment in accordance with the present invention.

Referring FIG. 6 which illustrates a standard scoring sheet 600 after a $10^{th}$ frame of bowling 602 has been completed/filled. Upon filling the $10^{th}$ frame, each bowler will now have a completed bowling score for that round of bowling as shown in column 602. For example: bowler 1A-"Jim" has a bowling score 606 of "300", bowler 1B-"Ashley" has a bowling score 608 of "205", bowler 1C-"Mary" has a bowling score 608 of "185", bowler 2A-"Nicole" has a bowling score 610 of "183", and bowler 2B-"Mike" has a bowling score 612 of "175". After completing the $10^{th}$ frame and determining the standard bowling score for each player, a poker hand is evaluated for each player. The poker hand comprises the best possible poker hand for each player made from the two hole cards and the five community cards (flop, turn and river). Each winning poker hand is awarded a predefined number of points and these additional points are added to the standard bowling score 606, 608, 610, 612, and 614 of each player to obtain an enhanced bowling score or a "Bowl N Hold-em™" score. By winning poker hand it is meant that the multi-card poker hand formed be of sufficient ranking to award extra points. In one exemplary embodiment, the multi-card poker hand is compared to a predefined table of ranked multi-card poker hands. For example, a multi-card poker hand may be a royal flush in which case an extra 100 points would be awarded to the player having this multi-card poker hand, this would be a winning poker hand. Conversely, in another example, a player may have a multi-card poker hand that is devoid of even a single pair and in this case no extra points would be awarded. The following is an exemplary table of poker hand rankings and points that will be added to each standard bowling score for each player.

| RANK | POKER HAND | DESCRIPTION | POINTS |
|---|---|---|---|
| 1 | Royal Flush | A, K, Q, J, 10 of same suit | 100 |
| 2 | Straight Flush | Five cards of same suit in sequence | 75 |
| 3 | 4 of a Kind | Four cards of same rank | 50 |
| 4 | Full House | Three of a kind plus a pair | 40 |
| 5 | Flush | Five cards of the same suit | 25 |
| 6 | Straight | Five cards in sequence | 20 |
| 7 | 3 of a Kind | Three cards of the same rank | 15 |
| 8 | 2 Pair | Two pairs of different rank | 10 |
| 9 | 1 Pair | Two cards of the same rank | 5 |

Figure 7:
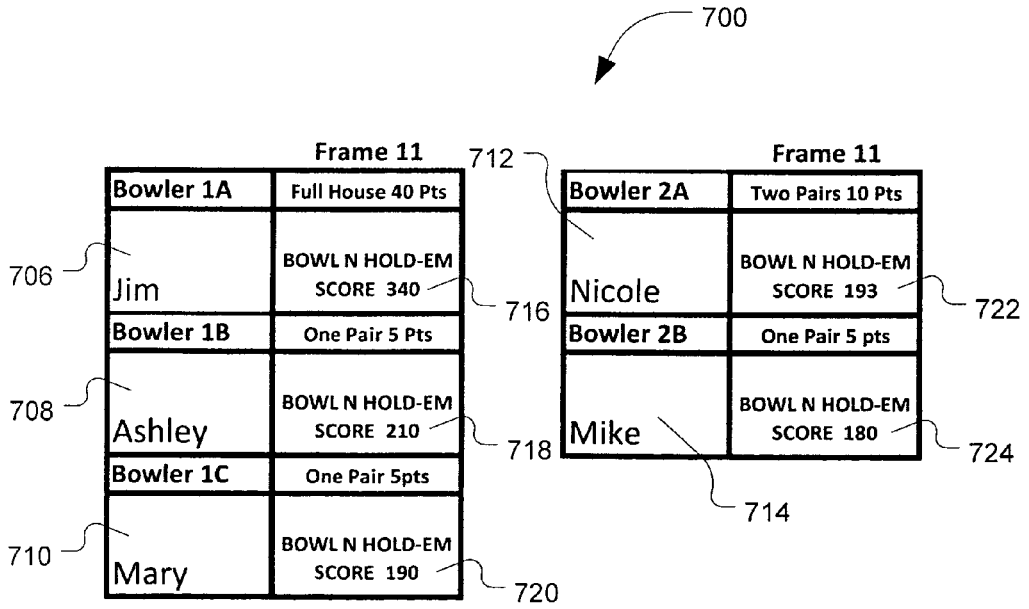
FIG. 7 illustrates a modified scoring sheet depicting an $11^{th}$ frame that combines a bowling score with a poker hand score as used in an exemplary embodiment in accordance with the present invention.

An enhanced bowling score for each player is illustrated in a modified scoring sheet 700 in FIG. 7. The enhanced bowling score combines a standard bowling score from scoring sheet 600 with points awarded for a winning poker hand from the table above. For example: bowler 1A-"Jim" 706 had a full house worth 40 extra points and thus has an enhanced bowling score 716 of "340", bowler 1B-"Ashley" 708 had one pair worth 5 extra points and thus has an enhanced bowling score 718 of "210", bowler 1C-"Mary 710 had one pair worth 5 extra points and thus has an enhanced bowling score 720 of "190", bowler 2A-"Nicole" 712 had two pair worth 10 extra points and thus has an enhanced bowling score 722 of "193", and bowler 2B-"Mike" 714 had one pair worth 5 extra points and thus has an enhanced bowling score 724 of "180". In one exemplary embodiment, the modified scoring sheet 700 is displayed as an electronic or digital image on the secondary display 108 of FIG. 1. In an alternate embodiment, the modified scoring sheet 700 may be displayed in a partitioned area of the primary display 106, where this partitioned area is separate from display of scoring sheet 600.

In one exemplary embodiment the enhanced bowling score may be utilized by the player to redeem various prizes/awards offered by the bowling center or offered by way of a frequent bowler program. Additionally, the player may decide to allow the points associated with the enhanced bowling score to accumulate over time so that the increased points may be used to redeem prizes/awards of higher value. In the alternative, the player may redeem various prizes based upon the poker award associated with a winning poker hand. For example, the player may have been awarded 100 points for having a royal flush and then obtain a prize/award worth 100 points. In this example, the prizes/awards are redeemed based on the poker award alone. This method of prize/award redemption is preferably applied to an "open-bowling" scenario. Open bowling is traditionally "non-league" and "non-tournament" bowling play used primarily for entertainment and/or practice purposes. By adding a poker feature to open bowling, the excitement of the player is increased and an opportunity to obtain one or more prizes is presented to the player.

Another contemplated use for the enhanced bowling score is applied to tournament bowling play. Traditionally, tournament play comprises an individual, a pair of individuals, or a team of individuals that collectively bowl one or more games of bowling and their combined scores are used to win various prizes or awards associated with their bowling score. The number of bowling games played during a tournament many vary depending upon rules established by a tournament host. It is contemplated that the enhanced bowling score, describe herein, may be used to increase the score of a bowler or team of bowlers at the completion of each game of the tournament. It is contemplated that the enhanced bowling score may be used for individual, doubles and team tournaments.

In an exemplary individual tournament, the enhanced bowling score for an individual bowler obtained at the completion of each game will be accumulated throughout the tournament resulting in an accumulated enhanced bowling score such as an accumulated tournament score. This final accumulated tournament score is then used to rank that bowler in the tournament standings.

In an exemplary doubles tournament, where a pair of bowlers bowl together and compete against other pairs of bowlers, the enhanced bowling score for each individual bowler that makes up a pair of bowlers is combined at the completion of each game. The combined enhanced bowling score for the pair of bowlers is then accumulated for each game in the tournament resulting in a final accumulated tournament score. This final accumulated tournament score is then used to rank that pair of bowlers in the tournament standings.

In an exemplary team tournament, where multiple bowlers bowl together to form a team and compete against other teams of bowlers, the enhanced bowling score for each individual bowler that makes up a team of bowlers is combined at the completion of each game. The combined enhanced bowling score for the team of bowlers is then accumulated for each game in the tournament resulting in a final accumulated tournament score. This final accumulated tournament score is then used to rank that team of bowlers in the tournament standings.

Another contemplated use for the enhanced bowling score is applied to league bowling play. Traditionally, league play comprises a group of bowlers that meet at a scheduled time each week for a predetermined number of weeks. The league generally comprises multiple groups of individual bowlers, each group of bowlers make up a team. Each team consists of two or more bowlers, depending on the league format. The meeting time, duration of league play, number of bowlers on each team and games bowled during each scheduled meeting will vary according to the hosting facility and specific league format/rules. In a normal league format, two teams are matched against each other on a pair of lanes. The team with the highest accumulated bowling score on each pair of lanes, after each game, wins one or more point(s). Teams are ranked throughout the league season according to the points they accumulate each week and listed on a standing sheet.

In an exemplary embodiment of league play, where multiple bowlers bowl together to form a team and compete against other teams of bowlers each week, the enhanced bowling score for each individual bowler that makes up the team is combined at the completion of each game resulting in an accumulated enhanced bowling score such as a final accumulated league score. This final accumulated league score is then used to rank the teams of bowlers for that game and award points based upon the team rankings for that game. Utilizing the enhanced bowling score, described herein, allows teams to accumulate more points and thereby assign the team a higher ranking on the standing sheet.

It is further contemplated that the method and system described herein may be used to host group bowling parties such as corporate events, holiday parties, merchandise parties or other social gatherings. The group bowling parties may be held using the computerized version, or manual version of the method described herein. During the manual version of the game, an individual that participates in hosting the event will serve as a card dealer, for the poker aspect of the game. Using either version, hosting a group bowling party, in accordance with the present invention, would allow those in attendance an opportunity to win a variety of prizes according to their enhanced bowling score, or poker hands. Group bowling parties produce a festive and entertaining, atmosphere to the game of bowling.

In an alternate exemplary embodiment, the $10^{th}$ frame may present the players participating in the poker aspect of the game with a bonus opportunity. This bonus opportunity adds excitement to the game and provides the players with a chance to improve their poker hand. In this embodiment, should a player obtain three consecutive strikes in the tenth frame, commonly referred to as "striking out (XXX)", the player is dealt the highest ranking available card from the collection. This highest ranking card then replaces the least desired hole card of the player, to thereby increase the odds of forming a winning poker hand when the hole cards are combined with the community cards.

Figure 8:
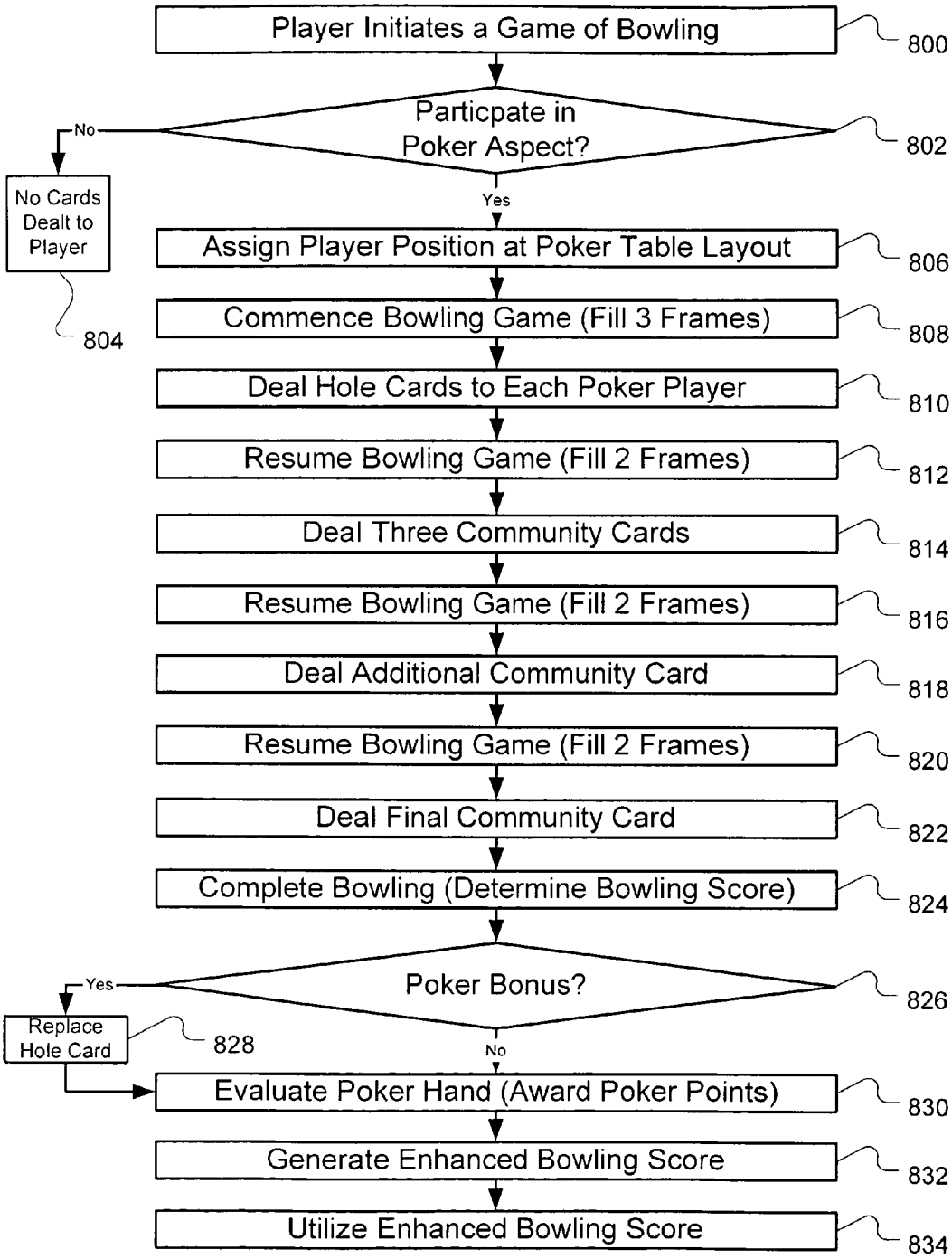
FIG. 8 is a flow diagram of a method of playing a bowling game in combination with a secondary card game according to an exemplary embodiment of the present invention.

Drawing attention to FIG. 8 which is an operational flow diagram illustrating potential steps for playing a bowling game in combination with a secondary poker-type card game. It is contemplated that most bowling participants would welcome an opportunity to increase the excitement of a bowling game and would appreciate the possibility to win an extra prize or award. Correspondingly, the following exemplary embodiment describes an implementation of the present invention that provides additional player excitement and an opportunity to obtain an additional prize/award.

At a step 800, a player or plurality of players initiates a conventional game of bowling. Typically, each player will provide their name so that their bowling scores/performance can be correctly associated with them. These names may be either manually entered into a paper scoring sheet or electronically entered into an automated scoring system. Next, at a step 802, each player will determine if they wish to participate in a secondary poker-type card game aspect of the bowling game in accordance with the invention disclosed herein. Should the player decide not to participate, then no cards will be dealt to that player at a step 804, and the player will be permitted to participate in the conventional bowling game only. Conversely, should the player decide to participate in the poker aspect of the bowling game, the player will be assigned a player position at the poker table layout at a step 806. In one exemplary embodiment, the player choosing to participate in the poker aspect of the game may be required to pay a fee, the funds acquired by charging this fee may then be used to provide awards as described below. It is contemplated that the poker player layout may either be a physical space provided at the bowling station or a virtual layout displayed via digital graphics on a display such as a TV, CRT, LCD or other display device.

Next, at a step 808, a conventional game of bowling is commenced and proceeds according to standard bowling rules, well-known to bowlers. The bowling game will continue until three frames are filled for each player. Upon completing the 3rd frame, at a step 810, two hole cards are dealt to each player participating in the poker aspect of the bowling game. The hole cards are dealt face up to each player and may be either physically dealt from a shuffled or randomly generated collection of cards or virtually dealt by way of an automated scoring system and computer. In the case where the cards are physically dealt, it is contemplated that the participating poker players would agree and assign one person to function as the dealer of the cards. The dealer may either be a poker participant, a player that declined to participate in the poker aspect of the game or a neutral party such as person hosting the bowling session.

The bowling game continues normally, at a step 812, until two more frames are filled by each player. After filling the 5th frame, at a step 814, three community cards, known as a "Flop", are dealt face up to a pre-designated community card area. As describe above these community cards may either be physically dealt or virtually represented on an electronic display device. Bowling play is resumed for an additional two frames as provided at a step 816. Upon filling these additional two frames, another community card, known as a "Turn" card, is dealt face up at a step 818 to the community card area after the 7th frame is filled by all the players. Next, bowling continues at a step 820 to fill two more frames for each player. After filling the 9th frame, at a step 822, a final community card, known as a "River" card, is dealt face up to the community card area. Subsequent to the final community card being dealt, the players complete the bowling game by filling the remaining frame/frames of the bowling game at a step 824.

Upon completing the final frame of bowling, it is determined if any of the players are eligible for a poker bonus at a step 826. It is contemplated that a bonus may be available to any player active in the poker aspect that obtains three consecutive strikes in the final frame. If a player has obtained three strikes in the final frame, then at a step 828, that player has one hole card replaced with the next highest card available in the collection of cards and proceeds to a step 830. If a player does not obtain three strikes, then no hole cards are replaced. At a step 830, each player participating in the poker aspect, has a poker hand that is evaluated according to the table provided above. Each player combines their two hole cards and all the community cards to form the best possible five card poker hand out of the seven available cards. Points are awarded for the ranking of winning poker hands. An enhanced bowling score is calculated at a step 832. The enhanced bowling score is the sum of the standard bowling score, determined at a step 824, and the awarded poker hand points determined at a step 830. The enhanced bowling score is then utilized to determine a ranking and/or provide poker prizes to players participating in the poker aspect of the bowling game at a step 834. The rankings may used in tournament play or league play as describe above. It is contemplated that the player poker prizes may be any one of several types of open bowling prizes/awards such as: dining coupons, merchandise, free rounds of bowling play, free equipment rentals, movie tickets, concert tickets, complimentary items/services or combinations thereof.

As will now be apparent, bowling games played according to the teachings of the invention provide a number of advantages over known methods and systems which do not have a secondary poker-type card game combined with a conventional game of bowling as described herein.

Incorporating the use of a poker-type card game increases the excitement for each player by providing a second game that is played during the standard bowling game. This benefit is realized because the poker cards are dealt throughout the bowling match and thus excitement builds for each player until the final poker card is dealt and each player can determine their respective poker hand. As a result, all of the players participating in the poker aspect of the bowling game, have a second competitive opportunity to "win" during the standard bowling game. By providing a poker award or prize, such as a gift card, the players have chance to win additional prizes besides those that may be offered for winning the standard bowling game. Consequently, the players enjoy increased excitement and competitiveness during the bowling game.

Another benefit realized by the method and system disclosed herein is a simplified way of enhancing the excitement of bowling without adversely complicating the scoring of the underlying bowling game. By seamlessly incorporating a poker-type card game during standard bowling play, the underlying bowling game scoring rules remain unchanged. The poker aspect provides an easily understood secondary avenue of game play. Further, poker-type games are generally well-known and the rules, hand rankings and awards are easily and efficiently explained to new players. As a result, the bowling game can be greatly enhanced while facilitating the standard scoring process.

While various embodiments of the invention have been described, it will be apparent to those of ordinary skill in the art that many more embodiments and implementations are possible that are within the scope of this invention. Firstly, the number of filled frames completed between dealing cards can be modified to accommodate bowling games that use fewer or more than the conventional number of frames. Secondly, the number of frames filled between dealing cards may be increased or decreased in order to build additional excitement and suspense. Thirdly, other poker hand rankings and associated point awards may be modified to provide more or less points for any particular poker hand. Fourthly, the hole cards dealt to the player/bowler may be dealt or spaced throughout the bowling game as desired by the game designer to enhance the excitement and suspense of the game. Finally, other types of poker games may be combined such that number of cards dealt at each dealing step may either increase or decrease. In addition, the various features, elements, step combinations and embodiments described herein may be claimed or combined alone in any combination or arrangement.

What is claimed is:

1. A method of playing a bowling game in which players are permitted to participate in a secondary poker-type card game by election, the method comprising the sequential steps of:

(a) initiating a bowling game, wherein at least one player participates in a poker-type card game in combination with the bowling game;

(b) filling at least one bowling frame;

(c) dealing at least one card to the at least one player from a randomized collection of cards;

(d) continuing the bowling game and filling at least one first additional bowling frame;

(e) dealing at least one first community card, wherein the first community card is useable by the at least one player to assemble a poker hand;

(f) continuing the bowling game and filling at least one second additional bowling frame;

(g) dealing at least one second community card, wherein the second community card is useable by the at least one player to assemble the poker hand;

(h) continuing the bowling game and filling at least one third additional bowling frame;

(i) dealing at least one third community card, wherein the third community card is useable by the at least one player to assemble the poker hand;

(k) completing the bowling game by filling a final bowling frame;

(l) determining a final bowling score for each player by executing machine readable code stored on a memory operatively coupled to a processor of a scoring computer, the machine readable code configured to enable the processor to determine a bowling score for each player;

(m) determining if the poker hand of the at least one player is a winning hand, wherein the poker hand is formed by combining the at least one card dealt to the at least one player, the at least one first community card, the at least one second community card and the at least one third community card to form a best multi-card poker hand; and (n) providing a poker award if the poker hand is a winning hand.

2. A method in accordance with claim 1 wherein said step (d) of continuing comprises the step of filling at least two additional bowling frames.

3. A method in accordance with claim 1 wherein said step (e) of dealing comprises the step of dealing at least three community cards.

4. A method in accordance with claim 1 wherein said step (f) of continuing comprises the step of filling at least two additional bowling frames.

5. A method in accordance with claim 1 wherein said step (h) of continuing comprises the step of filling at least two additional bowling frames.

6. A method in accordance with claim 1 further comprising the steps of:

determining if the at least one player obtained three consecutive strikes in the final bowling frame; and awarding a poker bonus if the at least one player obtained three consecutive strikes in the final bowling frame.

7. A method in accordance with claim 1 further comprising the step of providing a prize based upon the poker award.

8. A method in accordance with claim 1 further comprising the step of combining the poker award for each player with the final bowling score for each player to create an enhanced bowling score for each player.

9. A method in accordance with claim 8 wherein said step of combining the poker award includes the step of:

combining the enhanced bowling score for two or more players at the completion of each bowling game to create an accumulated tournament score.

10. A method in accordance with claim 8 wherein said step of combining the poker award includes the step of:

combining the enhanced bowling score for two or more players at the completion of each bowling game to create an accumulated league score.

11. A scoring system for a bowling game comprising:

at least one display device;

at least one scoring computer operatively coupled to said at least one display device;

said at least one scoring computer comprising:

a memory; and a processor operatively coupled to said at least one display device and said memory, said memory having a machine readable code stored therein, said machine readable code configured to enable said processor to execute the sequential steps of:

(a) initiate a bowling game, wherein at least one player participates in a poker-type card game in combination with the bowling game;

(b) score at least one bowling frame;

(c) display on the at least one display device at least one card virtually dealt to the at least one player from a randomized collection of cards;

(d) continue the bowling game and score at least one first additional bowling frame;

(e) display on said at least one display device at least one first community card;

(f) continue the bowling game and score at least one second additional bowling frame;

(g) display on the at least one display device at least one second community card;

(h) continue the bowling game and score at least one third additional bowling frame;

(i) display on the at least one display device at least one third community card;

(k) complete the bowling game by scoring a final bowling frame;

(l) determine a final bowling score for each player;

(m) determine if the poker hand of the at least one player is a winning hand, wherein the poker hand is formed by combining the at least one card dealt to the at least one player, the at least one first community card, the at least one second community card and the at least one third community card to form a best multi-card poker hand; and (n) provide a poker award if the poker hand is a winning hand.

12. A system in accordance with claim 11 wherein said machine readable code is configured to score at least two additional bowling frames at step (d).

13. A system in accordance with claim 11 wherein said machine readable code is configured to deal at least three community cards at step (e).

14. A system in accordance with claim 11 wherein said machine readable code is configured to score at least two additional bowling frames at step (f).

15. A system in accordance with claim 11 wherein said machine readable code is configured to score at least two additional bowling frames at step (h).

16. A system in accordance with claim 11 wherein said machine readable code is configured to determine if the at least one player obtained three consecutive strikes in the final bowling frame and award a poker bonus if the at least one player obtained three consecutive strikes in the final bowling frame.

17. A system in accordance with claim 11 wherein said machine readable code is configured to provide a prize based upon the poker award.

18. A system in accordance with claim 11 wherein said machine readable code is further configured to combine the poker award for each player with the bowling score for each player to generate and display on said at least one display device an enhanced bowling score for each player.

19. A system in accordance with claim 18 wherein said machine readable code is further configured to combine the enhanced bowling score for two or more players at the completion of each bowling game to create an accumulated tournament score.

20. A system in accordance with claim 18 wherein said machine readable code is further configured to combine the enhanced bowling score for two or more players at the completion of each bowling game to create an accumulated league score.

21. A method of playing a bowling game in which players are permitted to participate in a secondary poker-type card game by election, the method comprising the sequential steps of:

(a) initiating a bowling game, wherein at least one player participates in a poker-type card game in combination with the bowling game;
(b) filling three bowling frames;
(c) dealing two cards to the at least one player from a randomized collection of cards;
(d) continuing the bowling game and filling a fourth and a fifth bowling frame;
(e) dealing a set of three community cards, wherein the three community cards are useable by the at least one player to assemble a poker hand;
(f) continuing the bowling game and filling a sixth and a seventh bowling frame;
(g) dealing a fourth community card, wherein the fourth community card is useable by the at least one player to assemble the poker hand;
(h) continuing the bowling game and filling an eighth and a ninth bowling frame;
(i) dealing a fifth community card, wherein the fifth community card is useable by the at least one player to assemble the poker hand;
(k) completing the bowling game by filling a final tenth bowling frame;
(l) determining a final bowling score for each player by executing machine readable code stored on a memory operatively coupled to a processor of a scoring computer, the machine readable code configured to enable the processor to determine a bowling score for each player;
(m) determining if the poker hand of the at least one player is a winning hand, wherein the poker hand is formed by combining the two cards dealt to the at least one player, and three of the five community cards to form a best multi-card poker hand; and
(n) providing a poker award if the poker hand is a winning hand.

22. A method in accordance with claim 21 further comprising the step of combining the poker award for each player with the final bowling score for each player to create an enhanced bowling score for each player.

23. A method in accordance with claim 22 wherein said step of combining the poker award includes the step of combining the enhanced bowling score for two or more players at the completion of each bowling game to create an accumulated enhanced bowling score.

24. A method of playing a bowling game in which players are permitted to participate in a secondary poker-type card game by election, the method comprising the sequential steps of:
(a) initiating a bowling game, wherein at least one player participates in a poker-type card game in combination with the bowling game;
(b) dealing at least one card to the at least one player during the bowling game, wherein the at least one card is from a randomized collection of cards;
(c) dealing a plurality of community cards during the bowling game, wherein the plurality of community cards is useable by the at least one player to assemble a poker hand;
(d) completing the bowling game by filling a final bowling frame;
(e) determining a final bowling score for each player by executing machine readable code stored on a memory operatively coupled to a processor of a scoring computer, the machine readable code configured to enable the processor to determine a bowling score for each player;
(f) determining if the poker hand of the at least one player is a winning hand, wherein the poker hand is formed by combining the at least one card dealt to the at least one player, and the plurality of community cards to form a best multi-card poker hand; and
(g) providing a poker award if the poker hand is a winning hand.

* * * * *